US009046333B2

(12) United States Patent
Masinelli

(10) Patent No.: US 9,046,333 B2
(45) Date of Patent: Jun. 2, 2015

(54) BULLET

(75) Inventor: Kyle A. Masinelli, Staunton, IL (US)

(73) Assignee: Olin Corporation, East Alton, IL (US)

( * ) Notice: Subject to any disclaimer, the term of this patent is extended or adjusted under 35 U.S.C. 154(b) by 35 days.

(21) Appl. No.: 13/233,444

(22) Filed: Sep. 15, 2011

(65) Prior Publication Data

US 2012/0067245 A1 Mar. 22, 2012

Related U.S. Application Data

(60) Provisional application No. 61/383,989, filed on Sep. 17, 2010.

(51) Int. Cl.

| | |
|---|---|
| ***F42B 30/02*** | (2006.01) |
| ***F42B 12/34*** | (2006.01) |
| ***F42B 12/74*** | (2006.01) |
| ***F42B 12/78*** | (2006.01) |
| ***F42B 12/36*** | (2006.01) |

(52) U.S. Cl.

CPC ..... *F42B 30/02* (2013.01); *F42B 12/367* (2013.01); *F42B 12/78* (2013.01); *F42B 12/34* (2013.01); *F42B 12/74* (2013.01)

(58) Field of Classification Search

CPC ..... F42B 12/34; F42B 12/367; F42B 12/74; F42B 12/76; F42B 12/78; F42B 30/02; F42B 12/36

USPC ..... 102/506, 507, 508, 509, 514, 516, 517

See application file for complete search history.

(56) References Cited

U.S. PATENT DOCUMENTS

| | | | | |
|---|---|---|---|---|
| 1,967,416 | A * | 7/1934 | Leussler | 102/507 |
| 3,142,256 | A * | 7/1964 | Mack | 102/514 |
| 3,173,371 | A * | 3/1965 | Manshel | 102/507 |
| 3,230,886 | A * | 1/1966 | Woodring | 102/507 |
| 3,580,178 | A * | 5/1971 | Kopsch et al. | 102/515 |
| 4,387,492 | A * | 6/1983 | Inman | 86/55 |
| 4,879,953 | A * | 11/1989 | Carter | 102/507 |
| 5,101,732 | A * | 4/1992 | Schluckebier | 102/509 |
| 5,208,424 | A * | 5/1993 | Schluckebier et al. | 102/509 |
| 5,385,100 | A * | 1/1995 | Corzine et al. | 102/507 |
| 5,404,815 | A * | 4/1995 | Reed | 102/507 |
| 5,641,937 | A * | 6/1997 | Carter | 102/507 |
| 6,182,574 | B1 * | 2/2001 | Giannoni | 102/516 |
| 6,546,875 | B2 * | 4/2003 | Vaughn et al. | 102/507 |
| 7,543,535 | B2 * | 6/2009 | Herrlinger | 102/514 |
| 8,256,352 | B2 * | 9/2012 | Masinelli | 102/507 |
| 8,393,273 | B2 * | 3/2013 | Weeks et al. | 102/506 |
| 8,646,389 | B2 * | 2/2014 | Masinelli | 102/514 |
| 2010/0018430 | A1 * | 1/2010 | Masinelli et al. | 102/507 |
| 2010/0212535 | A1 * | 8/2010 | Beal | 102/517 |
| 2010/0224093 | A1 * | 9/2010 | Wilhelm et al. | 102/507 |
| 2012/0227615 | A1 * | 9/2012 | Beal | 102/516 |

* cited by examiner

*Primary Examiner* — James S Bergin

(74) *Attorney, Agent, or Firm* — Harness, Dickey & Pierce, P.L.C.

(57) ABSTRACT

A bullet having a jacket, having a rear section, and a front section, having an open front end; a rear core disposed in the rear section of the jacket and bonded thereto; and a front core, separate from the rear core, disposed in the front section of the jacket, adjacent the open front end. The front section of the jacket can expand after impact with the target and release the front core to form an initial volume of disruption, while the rear core and at least the rear section of the jacket penetrate, past the initial volume of disruption.

25 Claims, 4 Drawing Sheets

BULLET

CROSS-REFERENCE TO RELATED APPLICATIONS

This application claims priority to U.S. Provisional Patent Application Ser. No. 61/383,989, filed Sep. 17, 2010, the entire disclosure of which is incorporated herein.

BACKGROUND

This section provides background information related to the present disclosure which is not necessarily prior art.

This invention relates to bullets and in particular, to a bullet with improved effectiveness.

There are a wide variety of bullet designs that allow bullets to achieve a broad range of functions. For example some bullets, such as hollow point bullets, are designed to rapidly expand after striking a target causing disruption and damage to the target. Other bullets are jacketed or otherwise, designed for deep penetration into the target. Each type of bullet has its uses, and usually one desired functionality involves trade-offs with respect to other desired functionalities.

SUMMARY

This section provides a general summary of the disclosure, and is not a comprehensive disclosure of its full scope or all of its features.

Embodiments of this invention provide a bullet with a desirable combination of effect on a target. A bullet in accordance with the preferred embodiment of this invention comprises a jacket, having a rear section, and a front section, with an open front end. A rear core is disposed in the rear section of the jacket and bonded thereto. A front core, separate from the rear core, is disposed in the front section of the jacket, adjacent the open front end.

When the bullets of the preferred embodiment are fired, the open front end of the jacket opens after impact with the target and releases the front core to create an initial volume of disruption. The rear core, and at least the rear section of the jacket, can penetrate past the initial volume of disruption. Thus, the bullets of the preferred embodiment can provide significant subsurface disruption of the target and deep penetration. This combined action can be more effective at disabling the target than prior conventional bullets.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
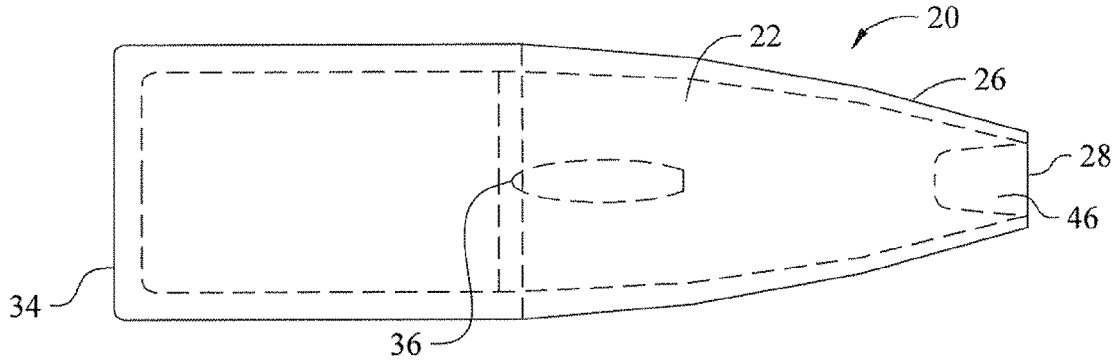
FIG. 1 is a side elevation view of a preferred embodiment of a bullet constructed according to the principles of this invention.
Figure 2:
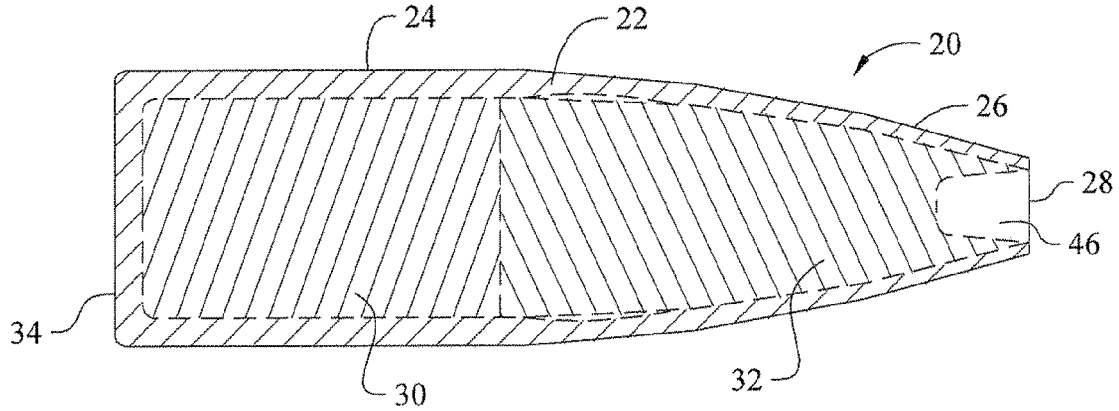
FIG. 2 is a longitudinal cross-sectional view of the preferred embodiment of a bullet constructed according to the principles of this invention.
Figure 3:
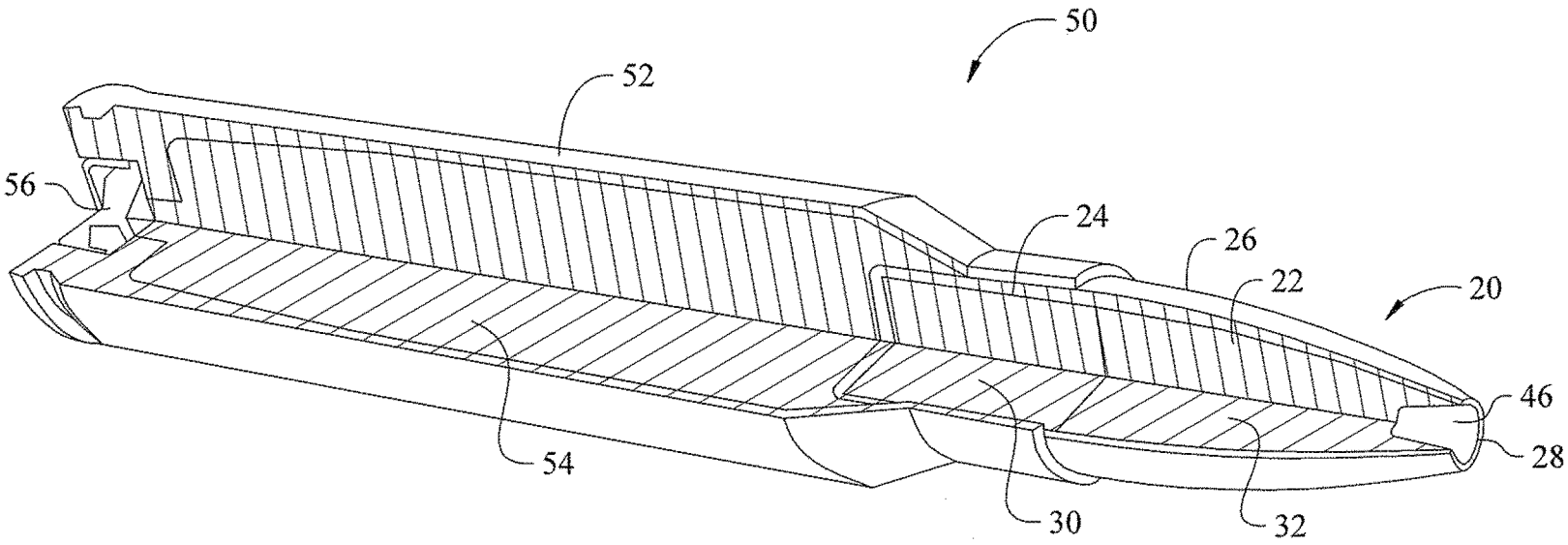
FIG. 3 is a perspective view of a round of ammunition incorporating the preferred embodiment of a bullet constructed according to the principles of this invention, with a section removed to show details of construction.

A preferred embodiment of a bullet constructed according to the principles of this invention is indicated generally as 20 in FIGS. 1-3. As shown in FIGS. 1-3, bullet 20 comprises a jacket 22, having a rear section 24, and a front section 26, with an open front end 28. A rear core 30 is disposed in the rear section 24 of the jacket 22 and bonded thereto. A front core 32, separate from the rear core 30, is disposed in the front section 26 of the jacket 22, adjacent the open front end 28.

The jacket 22 is preferably formed of one piece, with a closed rear end 34. The rear section 24 of the jacket 22 is preferably generally cylindrical. The front section 26 preferably smoothly transitions from a generally cylindrical configuration adjacent the rear section 24, to a tapering configuration adjacent the open front end 28. The wall of the jacket 22 at the rear section 24 is preferably thicker than the wall at the front section 26, with a smooth tapering transition therebetween. The inventor has discovered that if the thickness of the wall of the jacket 22 at the rear section 24 is at least 185% of the thickness of the wall at the front section 26, and more preferably at least 200% of the thickness of the wall at the front section then the bullet functions better. When the difference in thickness is less than 185%, then (depending on the properties of the jacket and cores), the rear section 24 does not remain intact, reducing the mass that penetrates deeply into the target and/or reducing the depth of penetration. In the preferred embodiment, the thickness of the wall at the rear section 24 of the jacket 22 is 214% of the thickness of the wall at the front section 26 of the jacket.

The jacket 22 is preferably made of copper or a copper alloy. The interior of the jacket preferably has at least one notch 36 formed therein between the rear section 24 and the front section 26 of the jacket 22. This facilitates the opening and separation of the parts of the jacket corresponding to the front section 26 of the jacket, while allowing the rear section 24 and the rear core 30 to remain substantially together.

The rear core 30 is preferably made of a dense material, such as lead. However, if a lead-free bullet is desired, the core 30 could be made of some other relatively dense metal or metal alloy, such as tin, tungsten, iron, or alloys thereof.

The front core 32 can be made of the same material as the rear core 30, but it could be made of a different material. For some applications, it may be desirable that the front core 32 be frangible. In these applications, the forward core can be made of consolidated powdered metal (e.g. powdered metal that has been formed into a solid by binding, compacting, sintering, or other suitable means) or other suitable material. In this preferred embodiment, the rear core 30 and the front core 32 are roughly the same size and weight, although they may or may not be differently shaped. The front core could be formed with a taper to accommodate forming the jacket into the final tapered configuration of the bullet. However, the rear core 30 and the front core 32 may be made of different sizes and weights, with either the rear core 30 or front core 32 being larger.

In one exemplary version of the preferred embodiment, the bullet 20 is a 22 caliber bullet, and the jacket 22 is 0.760 inches long, about 0.023 inches thick at its thickest, and is made from 21.6 gr of CDA220. The rear core 30 is made of 19.2 gr of #4 lead alloy (containing 0.5% Sb). Similarly, the front core 32 is made of 19.2 gr of #4 lead alloy (containing 0.5% Sb).

Manufacture

Figure 4:
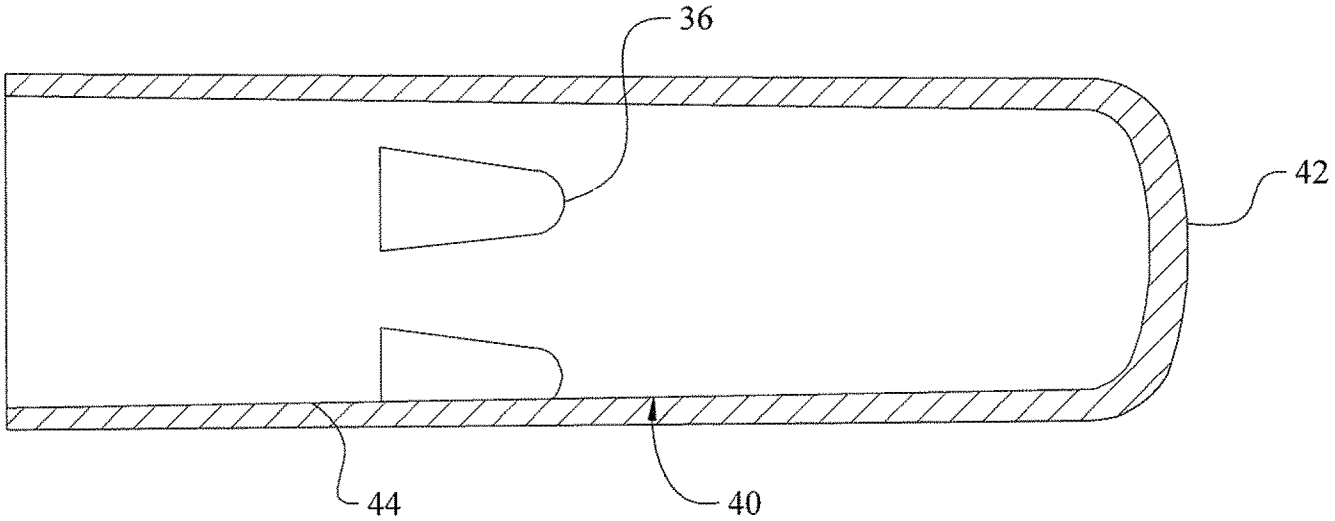
FIG. 4 is an enlarged longitudinal cross-sectional view of the cup-shaped jacket pre-form used in making bullets of the preferred embodiment.

The bullet 20 can be easily manufactured by drawing a cup-shaped jacket pre-form, indicating generally as 40 in FIG. 4, having a closed bottom 42, which forms the rear 34 of bullet, and a tapering sidewall 44, which forms the rear and front sections 24 and 26 of the jacket. A plurality of notches 36 are preferably formed on the interior of the sidewall 44, in the portion that will form the forward section 26 of the jacket. These notches 36 help the front section 26 of the jacket 22 open and break apart to release the front core 32. The rear core 30 is deposited in the cup-shaped jacket pre-form 40, together with some flux, and pressed into the bottom of the pre-form. The rear core 30 and the cup-shaped jacket pre-form 40 can be heated to bond the rear core to the jacket pre-form. The forward core 32 is then deposited into the cup-shaped jacket pre-form 40, and the sidewall 44 of the pre-from is formed into the tapering ogival profile with the open end of the per-form forming the open front end 28 of the bullet 20, and a small chamber 46 inside the jacket 22 above the front core 32.

The completed bullet 20 can be assembled into a cartridge 50 (FIG. 3), including a shell casing 52, propellant 54, and a primer 56 in the heel of the shell casing.

Operation

Figure 5:
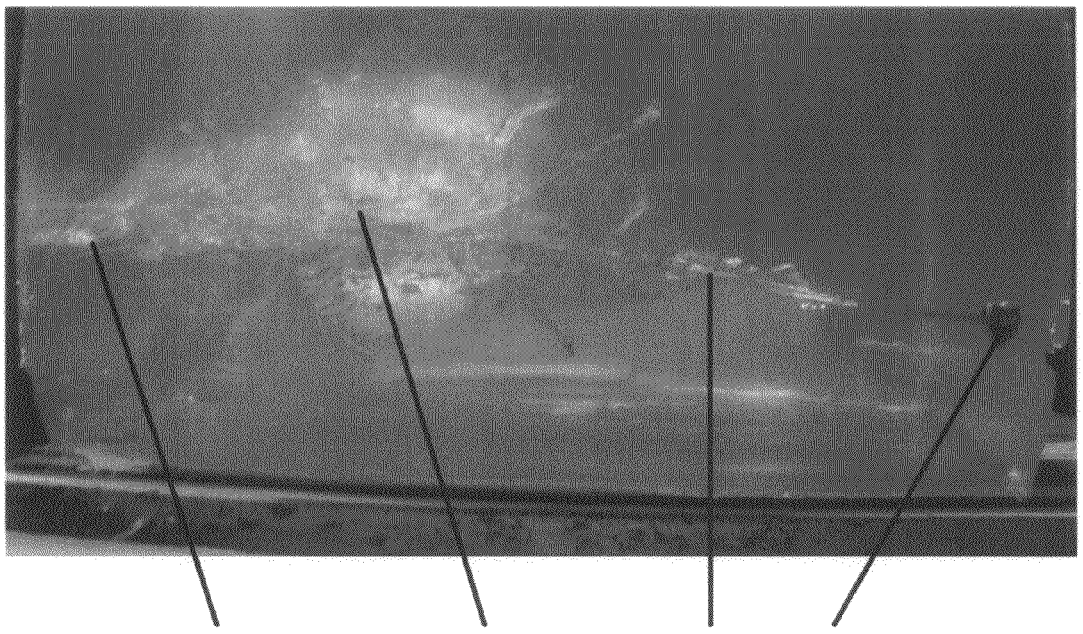
FIG. 5 is a photograph of a conventional ballistic gelatin block into which a bullet of the preferred embodiment has been fired.
Figure 6A:
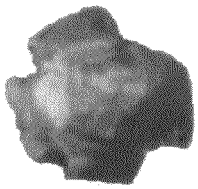
FIGS. 6A-6C are photographs of the bullet upset resulting when a bullet of the preferred embodiment has been fired into ballistic gelatin.
Figure 6B:
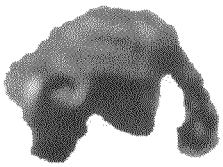
Figure 6C:
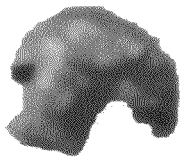

As shown in FIG. 5, when the bullet 20 is fired into a target (10% ballistic gelatin), the open front end 28 of the jacket 22 opens, fragmenting (due to the difference in thickness of the front section of the jacket and the notches 36 therein), and releasing the front core 32. This action forms an initial volume of disruption 60 below the surface of the target, starting at a point 62 between about 0.5 inch and about 2.5 inches (about 1.3 cm to about 6.4 cm) from the surface of the target, and ending at a point 64 between about 6 inches and about 9 inches (about 15 cm and about 23 cm) from the surface of the target. The rear core 30 and at least the rearward section 24 of the jacket 22, penetrate the target past the initial volume of disruption 60 to a point 66 between about 10 inches and about 14 inches (about 25 cm and about 36 cm) from the surface of the target. FIG. 6 shows the rear core 30 and rear portion of the jacket after firing. Thus, the bullet 20 provides a combination of significant target disruption with deep penetration.

FIG. 6 shows that because of the bonding between the jacket 22 and the rear core 30, the portion of the bullet 20 that achieves deep penetration, can retain at least 50% of the original mass of the bullet, and in most cases, at least 65% of the original mass of the bullet.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed:

1. A bullet comprising:

a jacket, the jacket having a rear section, a front section, and an interior surface, the front section of the jacket having an open front end;

a rear core disposed in the rear section of the jacket and bonded thereto;

a front core, separate from the rear core, disposed in the front section of the jacket, the front core being unbonded to either the jacket or the rear core, a space inside the jacket adjacent the front core communicating with the open front end of the jacket facilitating the expansion of the jacket when the bullet strikes a target;

at least one notch formed on the interior surface of the jacket adjacent the juncture between the front section and the rear section; the at least one notch defining an area of reduced thickness for facilitating the expansion of the jacket and the release of the front core to form an initial volume of disruption after impact with the target, with the rear core and at least the rear section of the jacket, penetrating past the initial volume of disruption.

2. The bullet according to claim 1 wherein the rear section of the jacket is closed.

3. The bullet according to claim 1 wherein the rear core and the front core are made of different materials.

4. The bullet according to claim 1 wherein the rear core and the front core are made of the same material.

5. The bullet according to claim 1 wherein the jacket is made of copper or a copper alloy.

6. The bullet according to claim 1 wherein the front and rear cores are made of lead or a lead alloy.

7. The bullet according to claim 1 wherein the front core is made of a friable material.

8. The bullet according to claim 7 wherein the friable material is made from consolidated powdered metal.

9. The bullet according to claim 1 wherein the jacket is thicker adjacent the rear core than adjacent the front core.

10. The bullet according to claim 9 wherein the thickness of the jacket adjacent the rear core is at least 200% of the thickness of the jacket adjacent the front core.

11. A bullet comprising:

a jacket, the jacket having a rear section, a front section, and an interior surface, the front section having an open front end;

a rear core disposed in the rear section of the jacket and bonded thereto;

a front core, separate from the rear core, disposed in the front section of the jacket, the front core being unbounded to the jacket and the rear core; and a space inside the jacket adjacent the front core communicating with the open front end of the jacket facilitating the expansion the jacket when the bullet strikes a target, so that the open front end of the jacket opens the front section of the jacket after impact with the target and releases the front core to form an initial volume of disruption with the rear core and at least the rear section of the jacket penetrating past the initial volume of disruption.

12. The bullet according to claim 11 wherein the rearward section of the jacket is closed.

13. The bullet according to claim 11 wherein the rear core and the forward core are made of different materials.

14. The bullet according to claim 11 wherein the rear core and the forward core are made of the same material.

15. The bullet according to claim 11 wherein the jacket is made of copper or a copper alloy.

16. The bullet according to claim 11 wherein the forward and rearward cores are made of lead or a lead alloy.

17. The bullet according to claim 11 wherein the forward core is made of a friable material.

18. The bullet according to claim 11 wherein the friable material is made of consolidated powdered metal.

19. The bullet according to claim 11 wherein the jacket is thicker adjacent the rear core than adjacent the front core.

20. The bullet according to claim 19 wherein there is a smooth tapering transition between the thicker wall thickness adjacent the rear core and the thinner wall thickness adjacent the front core.

21. The bullet according to claim 20 wherein the thickness of the jacket adjacent the rear core is at least 185% of the thickness of the jacket adjacent the front core.

22. The bullet according to claim 21 wherein the thickness of the jacket adjacent the rear core is at least 200% of the thickness of the jacket adjacent the front core.

23. The bullet according to claim 21 wherein the thickness of the jacket adjacent the rear core is 214% of the thickness of the jacket adjacent the front core.

24. The bullet according to claim 11 wherein the rear core penetrates to retain at least 50% of the original mass of the bullet.

25. The bullet according to claim 11 wherein the rear core penetrates to retain at least 65% of the original mass of the bullet.

* * * * *